United States Patent [19]

Lyons

[11] 4,191,791

[45] Mar. 4, 1980

[54] METHOD OF APPLYING A METAL COATING TO A METAL SUBSTRATE

[75] Inventor: John E. Lyons, Levittown, N.Y.

[73] Assignee: Eutectic Corporation, Flushing, N.Y.

[21] Appl. No.: 844,381

[22] Filed: Oct. 21, 1977

Related U.S. Application Data

[62] Division of Ser. No. 736,840, Oct. 29, 1976, Pat. No. 4,089,293.

[51] Int. Cl.[2] ..... B05D 1/08; B05D 3/08

[52] U.S. Cl. ..... 427/224; 427/225; 427/423; 427/425

[58] Field of Search ..... 427/423, 425, 424, 34, 427/225, 224; 118/7, 302, 321, 323

[56] References Cited

U.S. PATENT DOCUMENTS

| | | | |
|---|---|---|---|
| 2,110,755 | 3/1938 | Bleakley | 427/425 X |
| 2,939,410 | 6/1960 | Karpuk et al. | 266/48 X |
| 3,073,528 | 1/1963 | Wilson et al. | 239/79 |
| 3,415,449 | 12/1968 | Hawk, Sr. | 239/85 |
| 4,056,644 | 11/1977 | Howard et al. | 427/425 X |

*Primary Examiner*—Evan K. Lawrence

*Attorney, Agent, or Firm*—Hopgood, Calimafde, Kalil, Blaustein & Lieberman

[57] ABSTRACT

The method of the invention employs a gas torch which has the feature of selective addition of metal powder to the gas flow, in a cyclical pattern of metal-spraying and non-spraying (fusing) utilization of the same torch. The torch is caused to make short and relatively rapid transverse oscillations of sweep across the width of a swath along the workpiece, the swath developing in the course of a relatively slow feed (e.g., a longitudinal feed) of the torch with respect to the workpiece. The rate of torch feed and the duty cycle of metal application (vs. non-spraying) are related to the effective width of the metal "bead" thus sprayed, so as to assure (1) overlapping of adjacent beads and (2) fusing of adjacent beads to each other and to the workpiece. The embodiment which is described in detail has the almost universal capability of developing such torch-application along a swath of virtually any prescribed course, from straight longitudinal (single rectilineal component), to complex curvilinear (combination of rectilineal and rotational components), as for example to apply coating metal to what will become the cutting edge of a helical auger blade.

5 Claims, 8 Drawing Figures

METHOD OF APPLYING A METAL COATING TO A METAL SUBSTRATE

RELATED CASE

This application is a division of my copending application Ser. No. 736,840, filed Oct. 29, 1976, now U.S. Pat. No. 4,089,293.

BACKGROUND OF THE INVENTION

The invention relates to a method for applying metal coatings to metal substrates and is in particular concerned with gas-torch techniques wherein metal powder is deposited, as for example along an edge which is ultimately to serve as a cutting edge.

Prior techniques for the gas-torch application of metal coatings to metal substrates have involved hand-held devices requiring relative great skill in manipulation, if acceptable bonding and coating quality are to be achieved. As a practical matter, there is always a degree of uncertainty as to just how reliable the coating will be in use, so that testing procedures are costly and relatively elaborate, depending upon the degree of assurance desired. The problem is particularly acute for application of such metal coatings along a particular swath or edge which may undulate or be non-linearly characterized.

SUMMARY OF THE INVENTION

It is an object of the invention to provide an improved method for gas-torch application of metal coatings to metal substrates.

It is a specific object to meet the above object for situations in which the metal coating is to be applied along a swath in a surface of the substrate.

It is also a specific object to meet the above objects with virtual certainty of superior-quality coatings at all times.

It is another specific object to meet the above objects to a degree permitting the substantial reduction of testing procedures.

A further specific object is to provide an improved method of the character indicated whereby a predetermined metal coating may be applied to a given substrate, with complete reproducibility of a metal coating of precisely the same high quality and thickness, from one workpiece to the next, in a succession of similar workpieces to be treated.

A still further specific object is to meet the above objects for a coated swath which follows a non-linear course in the substrate surface.

A general object is to achieve the foregoing objects at substantial savings of expense for materials and labor, in both coating and testing operations, and with relatively great universality of application, in a large variety of workpiece configurations.

Briefly, the foregoing objects and other features of novelty and invention are achieved by employing a gas torch which has the feature of selective addition of metal powder to the gas flow, in a cyclical pattern of metal-spraying and non-spraying (fusing) utilization of the same torch, in application to and along a desired surface area of a workpiece to be coated. The torch is caused to make short and relatively rapid traverse oscillations of sweep across a swath along the workpiece, the swath developing in the course of a relatively slow feed (e.g., a longitudinal feed) of the torch and the workpiece with respect to each other. The rate of such torch feed and the duty cycle of metal-application sweeps vs. non-spraying (fusing) sweeps are related to the effective width (i.e., in the path feed direction) of the metal "bead" thus sprayed, so as to assure (1) at least some overlapping of successive beads and (2) fusing of adjacent beads to each other and to the workpiece.

BRIEF DESCRIPTION OF THE DRAWINGS

In the drawings, which show, for illustrative purposes only, a preferred embodiment of the invention.

DESCRIPTION OF THE PREFERRED EMBODIMENTS

Figure 1:
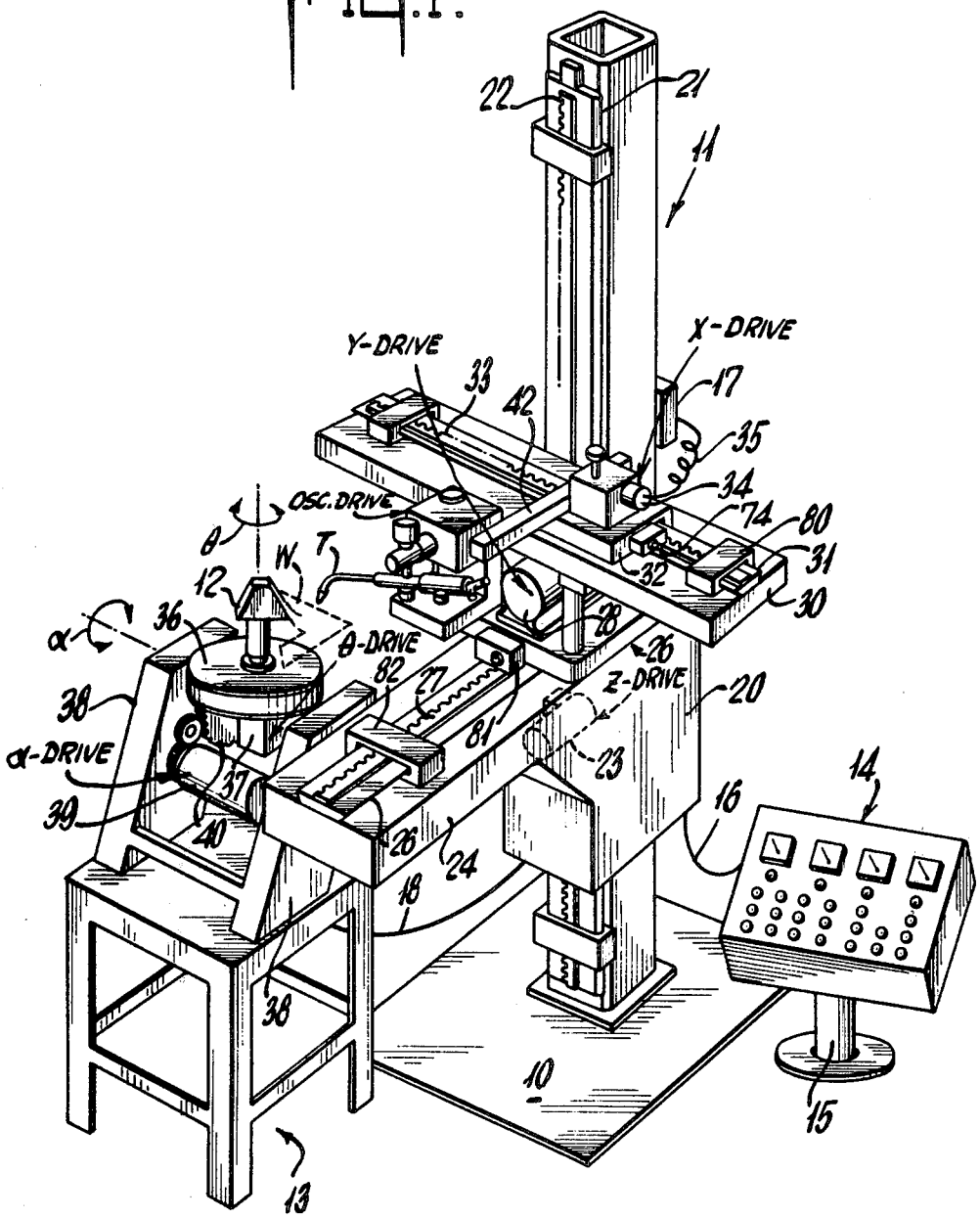
FIG. 1 is a simplified view in perspective of apparatus of the invention, illustratively shown in application to the metal coating of a cutting-edge region of a harrow "point"

In FIG. 1, the invention is shown in application to an automatic operation upon a workpiece W, shown in phantom outline as a harrow "point" to which a swath of coating metal is to be applied by a Torch T along each of two divergent cutting edges thereof. Generally, each cutting edge will be straight, but the orientation of these cutting edges with respect to the vertical plane of symmetry of mounting alignment (e.g., alignment of mounting to its intended supporting structure) involves complex angle components. The torch T is shown carried by unitary mechanism including a floor-mounted frame comprising a base 10 and a fixed upright column 11. The workpiece W is removably secured to a work holder 12 carried by unitary mechanism including a floor-mounted frame or stand 13. A control and monitoring panel 14 is also floor-mounted, upon a pedestal stand 15 and has flexible electrical connection 16 to the torch-mounting unit (at a junction box 17) and thence, via a further flexible electrical connection 18, to the work-mounting unit. The three stands 10-11, 13 and 14 may of course all be integrated into a single floor-mounted piece of equipment; however, I prefer that each of these units shall be separately floor-mounted as shown, for maximum flexible adaptability to various particular different job requirements and situations, in that any force reaction between torch-related and workpiece-related elements is negligible compared with the mass and relatively immobility of units 10-11, 13 and 14, once set in desired position on a given floor.

The torch-mounting unit includes three orthogonally related guide and drive systems for universal positioning of the torch T in space. Specifically, a main slide 20 is vertically guided in ways 21 forming part of column 11; along these ways, an elongate rack 22 is engaged by pinion means (not shown) but forming part of a Z-axis drive which includes motor means 23 carried by slide 20. The main slide 20 includes a horizontal arm 24. A secondary slide 25 is horizontally guided by ways 26 forming part of arm 24; along these ways (26), an elongate rack 27 is engaged by pinion means (not shown) but forming part of a Y-axis drive which includes motor means 28 carried by slide 25. Columns 29 at the corners of slide 25 mount another horizontal arm or deck 30, equipped with horizontal ways 31 which are orthogonal to the ways 26. A third slide 32, which is the ultimate supporting slide for torch T, is horizontally guided by the ways 31; along these ways (31) an elongate rack 33 is engaged by pinion means (not shown) but forming part of an X-axis drive which includes motor means 34 carried by slide 32. Suitable flexible cables, as at 35 from box 17 to the X-axis motor 34, will be understood to accommodate interconnection of all motor drives, and other moving parts including limit switches to be later described.

The workpiece holder 12 is shown mounted to and extending upwardly from a turntable 36, journaled in a cradle frame 37 for rotation about a generally vertical axis, for an aximuth or $\theta$ component of workpiece positioning; for the depicted accommodation of horrow points (see also FIG. 1A), the holder 12 comprises an upstanding column with oppositely sloping under flats to which shanks of two harrow points W may be secured, with their cutting edges symmetrically oriented substantially in a single plane which is normal to the axis of rotation $\theta$. The cradle 37 will be understood to include motor means (not shown, but suggested by the legend "$\theta$-Drive") whereby mounted workpieces may be driven about the $\theta$ axis. Cradle 37 is in turn supported for tilting adjustment about a second axis, orthogonal to the $\theta$ axis, being journaled on a horizontal axis through spaced upstanding arms 38 forming part of the stand 13; and an $\alpha$-Drive motor 39 is shown with pinion connection to a sector gear 40 for positioning cradle 37 about the horizontal axis of $\alpha$-displacement. The arms 38 are preferably canted forward, as shown, to place the horizontal axis of $\alpha$-tilt close to the forward legs of stand 13, for more convenient work placement with respect to torch T.

An important feature of the invention is concerned with developing a predetermined elongate path of metal coating upon a workpiece surface, as along and immediately adjacent one cutting edge thereof, and in the circumstance that the width of the desired path exceeds the width of a single bead that can be deposited by a single pass of the torch across the workpiece surface. To meet this situation, the torch T and the workpiece W are subjected to a relatively slow first component of feed motion governing torch progress along the intended path while also subjecting the torch T and the workpiece W to a relatively fast second component of oscillatory motion governing torch displacement generally transverse to the intended path. These two components of feed motion may be generated by different combinations of the drives thus far described—for example, for a straight horizontally oriented harrow point edge that is set parallel to the X-axis guideways 31, a slow X-drive rate, combined with a relatively rapid Y-drive oscillation, the latter being at short amplitude of shuttling reciprocation to thereby cover the width of the intended path. In the form shown, however, I indicate my preference for use of separate mechanism 41 to impart oscillating motion to torch T, such mechanism 41 being carried by and effectively part of the X-axis slide 32 but shown positioned away from ways 31 by an offsetting arm 42.

Figure 2:
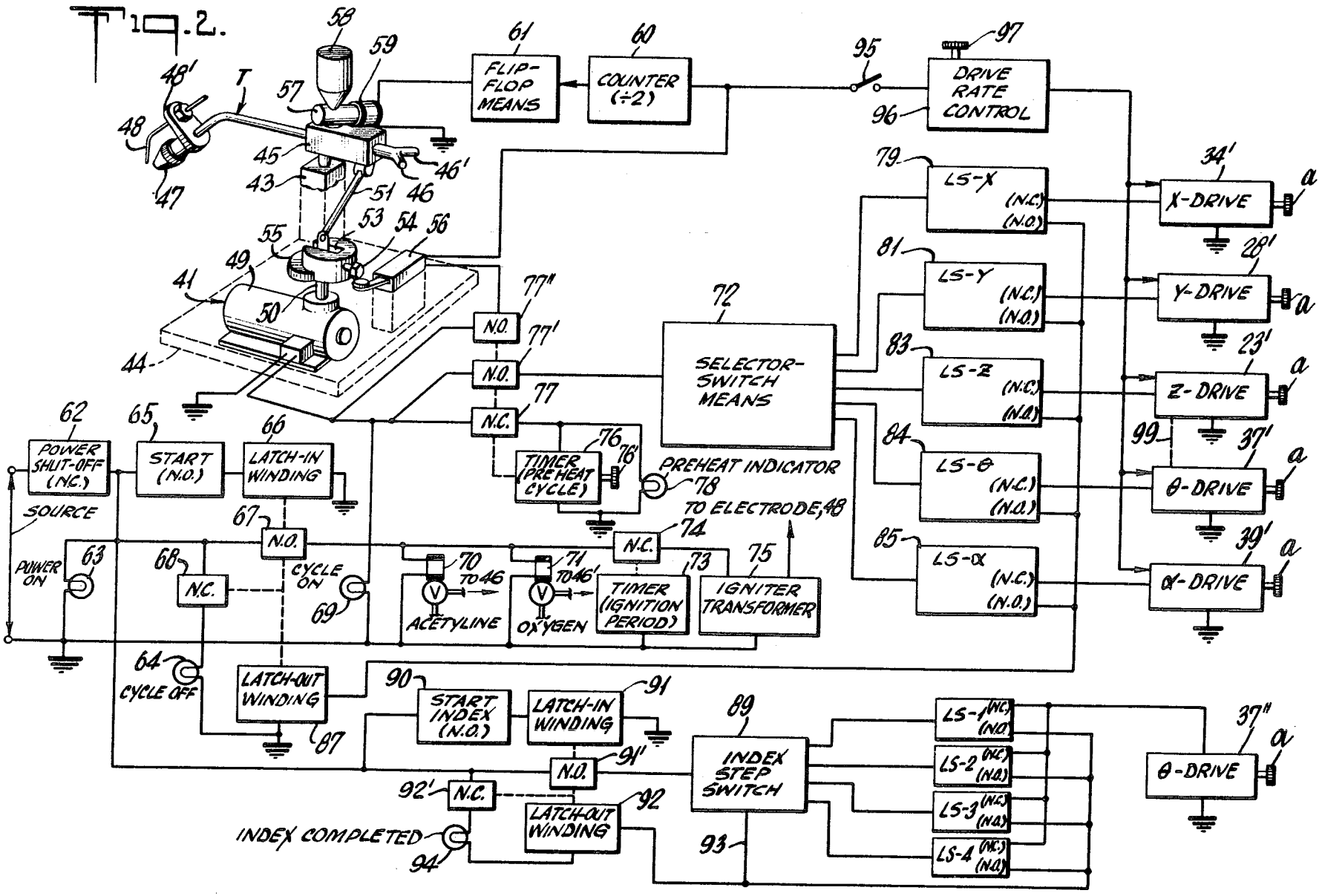
FIG. 2 is an electrical block diagram of circuitry to operate the machine of FIG. 1.

The functional relationship of torch T to its oscillating mechanism 41 will be better understood from the schematic showing at the upper left corner of FIG. 2, wherein a vertical pedestal 43 rises from a horizontal base 44 and provides a vertical axis of pivotal support for the torch body 45. Torch T includes separate inlets 46–46' for connection to oxygen and acetylene supplies, via flexible hoses (not shown), and a discharge of torch products issues from a downwardly and forwardly directed nozzle 47; electrode 48 is held by an offset arm 48' at fixed spacing from nozzle 47 and is excited, via a flexible lead, by means to be described. A continuously running motor 49 provides a reduction-gear output on a vertical shaft 50 for developing an eccentric motion, from which torch oscillation is picked off via a rod link 51. As shown, a boss 52 with a radial groove or slot 53 is mounted to shaft 50, and externally accessible means 54 enables radial-positioning adjustment of a crank-pin connection (in groove 53) to rod 51, thus determining selection of the amplitude of torch oscillation. Boss 52 is also shown with a cam formation 55 operative upon the probe arm of a limit switch 56, once per revolution of shaft 50, and for substantially one half of such revolution, for a valve-operating and synchronizing purpose to be explained.

Figure 3:
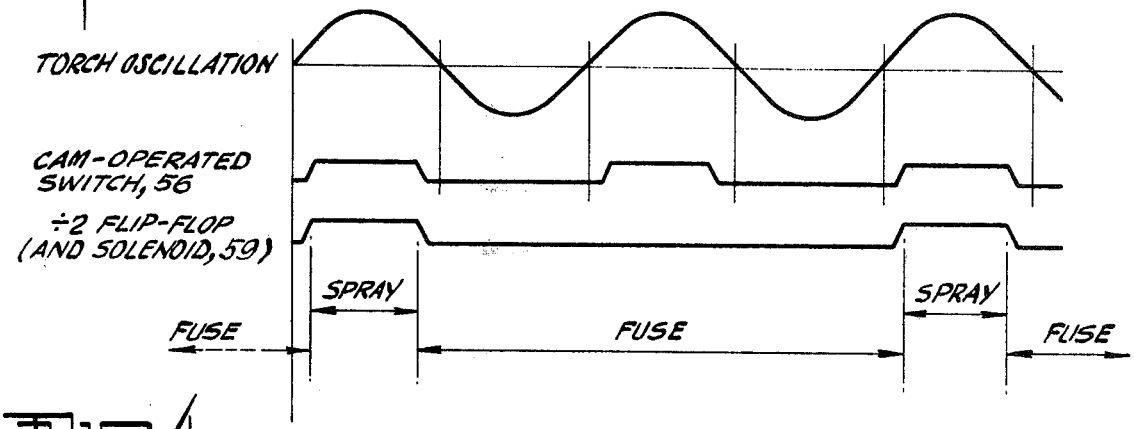
FIG. 3 is a graphical presentation to show several coordinated operations, to the same time base, in operation of the machine of FIG. 1.

Another important feature of the invention is that in the indicated torch-oscillating action, the metal powder to be applied to the workpiece shall be applied intermittently and in synchronism with the described oscillatory motion. I have been able to achieve highly satisfactory coatings, of smooth and uniformly continuous nature, using a cycle wherein powder flow is admitted to the gas flow in torch T, once (and for approximately a half cycle of oscillation) for every two cycles of oscillation. More particularly, the torch T (see FIG. 3) may include a valve 57 to control flow in an internal passage between a metal-powder supply 58 and the interior of torch body 45. The valve 57 is shown to be solenoid-operated at 59, being normally closed by spring means acting upon a rod to squeeze and close an elastomeric valve section of the powder passage. The described cycle of operating valve 57 is seen in FIG. 2 to rely upon a divide-by-two counter 60 connected to bi-stable flip-flop means 61 for controlling excitation of solenoid 59; and the curves of FIG. 3 show the synchronized relation between torch oscillation (curve a), the substantially half-cycle nature of closure of the cam-operated switch 56 (curve b), and the divide-by-two function of means 60–61 whereby solenoid 59 opens valve 57 only once for every two oscillatory cycles of torch T (cuve c). Legends applied at row d of FIG. 3 identify the metal-sparying and purely fusing functions which result for the described operation of valve 57.

FIG. 2 provides additional detail for an understanding of coordinated automatic operation of my machine, and for simplification all electrical return lines have been shown as grounded. Controls at the console 14 includes a power shut-off button 62 with normally closed contacts, and therefore circuit connection to a source (indicated by legend) will immediately illuminate (a) a lamp 63, signifying "power on" to the machine, and (b) a lamp 64, signifying "cycle-off", meaning that no cycle or other automatic function of the machine is yet in progress. A push button 65 is pressed to close it normally open contacts to supply momentary excitation to a "latch-in" winding 66 having normally open contacts 67 which are thus closed to latch (e.g., magnetically retain) power to an automatic cycle-control system; normally closed contacts 68 to lamp 64 are also operated by winding 66. Thus connected (upon closure of contacts 67 and opening of contacts 68), a "cycle-on" lamp 69 illuminates, the "cycle-off" lamp 64 extinguishes, and several parallel circuits are also simultaneously established, namely:

1. Solenoid actuation of valve means 70 to open position, governing admission of acetylene-gas supply to the torch inlet 46;
2. Solenoid actuation of valve means 71 to open position, governing admission of oxygen-gas supply to the torch inlet 46';
3. Start of the motor 49, thus initiating the torch-oscillation action already described;
4. Start of a preheat-cycle timer 76, to time out its period, predetermined by a adjustment at 76', it beint noted that timer 76 is provided with normally closed contacts 77 through which timer 76 is run, and with two sets of normally open contacts 77'-77" both of which close upon completion of the preheat-cycle timed interval;
5. Excitation of an indicator lamp 78, signifying that the preheat cycle is in progress;
6. Start of a timer 73 via its normally closed contacts 74 to govern a period of sparking from the ignition electrode 48 to nozzle 47; and
7. Excitation of an igniter transformer 75 havint its secondary connected to the lead to electrode 48. A short period, in the order of ten seconds, is more than ample for ignition time at 73, the same being disconnected at 74, upon lapse of the ignition-time interval.

During the preheat cycle, torch T courses the starting end of the desired coating path, but no feed advance is started, and no metal power is sprayed. Then, when the predetermined preheat-cycle interval has been timed out, the normally closed contacts 77 open, to extinguish the preheat-cycle indicator lamp 78, and to allow the ignition circuitry to reset. At the same time, normally open contacts 77' close to complete a circuit to selector-switch means 72, for initiation of one or more of the various feed drives, as appropriate for the particular working situation, all as preset in selector-switch means 72 and other circuitry to be described. Still further at the same time, contacts 77" close to complete a circuit to limit switch 56 and thus to the means for initiating and controlling the program of powder flow into the torch body 45.

It has been generally indicated that feed drives should be selected and set for the requirements of a particular job. There are five drive motors 23-28-34-37-39, and in FIG. 2 these motors and their respective drive controls are collectively designated by labeled boxes having primed notation for the same identifying numerals. Each of these drives, for example the X-drive 34', is operated via a series-connected limit switch (79) to one of the selectable outlet terminals of selector-switch means 72, such limit switch having normally closed contacts connected to its drive means and being mounted to monitor achievement of the preselected end of the particular drive, the end of the particular drive being additionally signalled by closure of normally open contacts of the same limit switch. Thus, for the X-axis situation, limit switch 79 may be carried by the X-axis alide 32, for ultimate coaction with an abutment 80, adjustably clamped to ways 31, for terminating the X-drive when the normally closed contacts of limit switch 79 are thereby opened; in like manner, another limit switch 81 carried by the Y-axis slide may coact with an end abutment 82 that has been adjustably clamped to the Y-axis ways 26, and the remaining drives are correspondingly served by the normally closed contacts of further limit switches 83-84-85.

Aside from the described normally closed limit-switch contact relationship to each of the inputs to drive 34'-28'-23'-37'-39', the normally open contacts of these limit switches are connected in parallel to complete a circuit to a "latch-out" winding 87 associated with contacts 70, thereby resetting the latter to their normally open condition and shutting down all machine operations, including any and all feed drives, torch oscillation, powder-flow, and torch-gas supplies. At this point, the coating will have been applied as a continuous and complete swath, and the workpiece may be removed from holder 12 for replacement with the next workpiece and for an exact repeat of the described operations; alternatively, and for the holder 12 accommodating two opposed harrow point workpieces W, with all surfaces to be coated in the same radial plane about the axis of $\theta$ rotation, the $\theta$-drive may be actuated to index the workpieces W for presentation of the next coating path to working position, e.g., parallel to the X-axis ways 31.

In FIG. 2, semi-automatic means are schematically shown for such indexing of the indicated workpieces W, for the simplified case in which for each harrow point, the cutting-edge surfaces to be coated are equally inclined on opposite ends of a plane of symmetry through the mounting means at holder 12. The termination of each indexing step, for the four surfaces (two on each harrow point) to be coated, is marked by the setting of successive limit switches (L.S.-1, 2, 3, 4) at adjustably fixed positions adjacent turntable 36 and about the axis of $\theta$-rotation, said limit switches being poised for successive actuation by a lug (not shown) on turntable 36 and said limit switches having normally closed contacts which open to terminate the particular increment of indexing ($\theta$) rotation which is selected by the currently stepped condition of step-switch means 89. The $\theta$-Drive 37" thus affected is preferably separate from the means 37' but is operative upon the same $\theta$-Drive motor, so as to avoid interference between a $\theta$-Drive for indexing and a $\theta$-Drive for a working feed. Indexing is started by depressing a push button 90 to pick up a latch-in winding 91, thus closing its normally open contacts, to supply power to the $\theta$-Drive 37" via the particular normally closed limit-switch circuit that is determined by the currently set condition of switch 89; indexing is completed when said particular limit-switch circuit is opened, thus closing its normally open contacts to complete a circuit to a latch-out winding 92 for returning contacts 91' to their normally open condition, while at the same time supplying a step-advancing impulse to the indexing step switch 89, at connection 93. Also at the same time, excitation of latch-out winding 92 operates associated normally closed contacts 92' to open condition, thereby extinguishing a lamp 94 and indicating that indexing has been completed.

The various drive boxes 34'-28'-23'-37'-37"-39' of FIG. 2 have been indicated schematically and are to be understood to suggest use of one or more of a variety of motor-drive controls. By the same token, adjustment knobs a at each of these boxes will be understood to suggest manual or other setting of the control function (for example, speed) for the particular motor drive involved. Thus, whichever one or more of the feed drives that has been selected by means 72 to be operative for a given working operation may involve steady, continuous and relatively slow feed during the course of the relatively rapid oscillatory traverse of the work path by reason of eccentric-throw pickoff by rod 51. Alternatively, upon selective closure of a switch 95, an intermittent feeddrive control 96 may be caused to advance the applicable one or more of the feed drives, once per eccentric cycle. To this end, closure of switch 95 enables means 96 to respond to the cam-operated output of switch 56 (curve b of FIG. 3), so that the particular feed drive is only advanced at such intermittent times, thus allowing at least one non-spraying torch impingement upon a given area of the working path for each metal-spraying pass of precisely the same area. Upon proper phase adjustment of output signal from (with respect to input signal to) the control means 96, such adjustment being suggested by manual means 97, the first torch pass over a specific traverse line may be a local surface preheating (non-spraying) pass, so that the next-ensuing pass may be metal-spraying. Thereafter, the cam-derived feed-advancing signal will be operative to advance the particular feed to the extent of substantially half the width of a spray bead while another full cycle of oscillation proceeds without metal spraying, thus avoiding extended time for fusing the most-recently deposited metal with respect to metal deposited on preceding passes.

Figure 4:
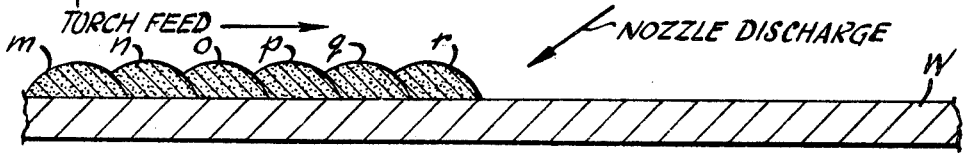
FIGS. 4 and 5 are similar simplified enlarged sectional views of a coated substrate in the course of a coating application to illustrate operation of the machine of FIG. 1.
Figure 5:
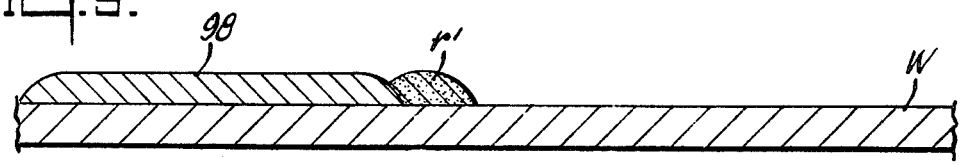

The foregoing discussion with respect to metal beads and spraying vs. fusing oscillatory traverses of the work path will be better understood from a consideration of FIGS. 4 and 5, both of which are simplified diagrams, for illustrative explanation only. The diagram of FIG. 4 depicts the application of successively sprayed beads m-n-o-p-q-r to the desired upper surface region of the workpiece W, in the course of torch feed in the direction indicated by legend and a heavy arrow, and with torch discharge directed as also indicated by an arrow. Successive beads longitudinally overlap each other to the extent of approximately 25 percent of the width of individual beads, but without an adequate fusing interval between successive spraying passes (e.g., in certain instances a one-half cycle of oscillation between successive spray passes is not sufficient), the beads do not fuse to each other; poor bonding results, as between each bead and adjacent substrate, and as between adjacent beads. On the other hand, with an extended fusing interval between spray passes, as suggested at c and d in FIG. 3, the fusing heat between bead sprays is effective to "puddle" each bead to those which preceded it, thus producing the smooth and continuous coating suggested at 98 in FIG. 5, with the most recently applied bead r' being due for "puddled" assimulation into the single coating layer 98 in the course of the three fusing (non-spraying) passes to occur before the next metal-spraying pass of the work path occurs.

The overlay coat 98 may range in thickness from about 0.005 inch to 0.02 inch, and each bead width may range from 0.05 to 0.3 inch, for a nozzle-discharge distance of about 0.75 inch.

Metal powder suitable for the described intermittently sprayed application to a metal substrate generally comprises self-fluxing nickel-base, cobalt-base, iron-base and copper-base alloys. The self-fluxing properties are due to the presence of silicon and boron in the coating-metal powder.

As regards the self-fluxing nickel-base, cobalt-base and iron-base alloys, the alloys generally contain by weight about 0.05 percent to 6 percent Si, about 0.5 percent to 5 percent B and up to about 3 percent C, the balance being essentially either nickel, or cobalt, or iron together with alloying elements, such as Cr, W and Mo.

A typical nickel-base alloy may contain by weight about 0.5 percent to 3 percent Si, about 1 percent to 5 percent B, 0 to about 15 percent Mo., 0 to 15 percent W, and the balance essentially nickel, the total Cr+Mo+W content ranging up to about 30 percent.

A typical cobalt-base alloy may range in composition by weight from about 0.5 percent to 3.5 percent Si, about 1 percent to 3 percent B, 0 to about 3 percent C, about 5 percent to 30 percent Cr, 0 to about 15 percent Mo, 0 to about 15 percent W, and the balance essentially cobalt, the total Cr+Mo+W content ranging up to about 30 percent.

The iron-base alloy may range in composition by weight from about 0.5 percent to 3 percent Si, about 1 percent to 3 percent B, 0 to about 3 percent C, about 5 percent to 25 percent Cr, 0 to about 15 percent Mo, 0 to about 15 percent W, and the balance essentially iron, the total Cr+Mo+W content ranging up to about 30 percent.

The indicated coating alloys are formulated to provide melting points ranging up to about 2500° F. (1371° C.), the melting points ranging from about 1800° F. (983° C.) to 2250° F. (1233° C.). The melting point is controlled by the amount of silicon and boron in the alloy. The coating is applied by flame-spraying an alloy powder of the composition (e.g., atomized powder). The alloy-powder particle can be of mesh size ranging from less than 125 mesh (about 125 microns) to about 400 mesh size (about 40 microns). Mesh size referred to herein is based on U.S. Standard.

It will be seen that I have described means and methods which meet all stated objects. My invention brings an individual art form to a predictable level of high performance and product quality, to the extent that far less operator skill is required, wastage of materials is substantially reduced, and production capabilities greatly enhanced. And these results are obtained for a tremendous variety of work requirements.

To illustrate efficacy of the invention, I provide below three specific examples of automated coating, using the machine which I have described.

EXAMPLE I

Figure 1A:
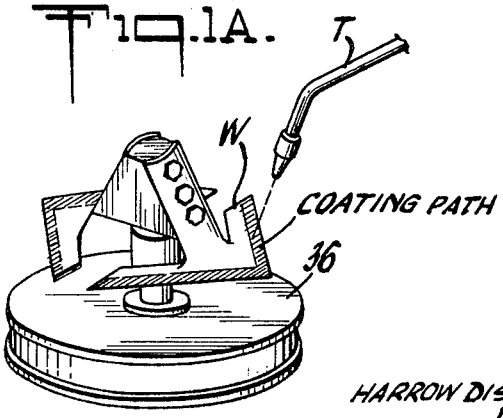
FIGS. 1A, 1B, 1C are simplified fragmentary views in perspective, to illustrate a variety of different workpieces which may be coated by the apparatus of FIG. 1.

Workpiece: Harrow Points, being catalog Part No. "479008R2-12" of International Harvester Company; top surface at right and left cutting edges to be coated, each with 0.75-inch wide path, of 9-inch length to path intersect at pointed end. Mounted in duplicate, as shown in FIG. 1A, and indexable in $\theta$ increments, for successive coatings of the four edges, as described above.

Oscillating Traverse Span: 1.00 inch

Traverse Cycle: 1 per second.

Metal-spray duty cycle: 20 to 25 percent of two-cycle period of oscillation.

Feed: Continuous, along X-axis.

Feed rate: 3–4 inches per minute.

Metal-Powder, at 58: "LUBROTEC 19985"*; about 1.5 to 2 ounces consumed per treated edge; coated-layer (98) thickness of about 0.025 inch.

* Trademark of Eutectic Corporation, New York, N.Y., for its machinable coating (overlay) powder.

REMARKS: Longitudinal cut through coated path, the cut being taken longitudinally along the path (in the sense of the sections of FIGS. 4 and 5), showed uniform layer as at 98, with no residuum of individual beads; puddling mix of adjacent beads was such as to eliminate outersurface ripple to substantially less than 10 percent of stated coating thickness.

EXAMPLE II

Figure 1C:
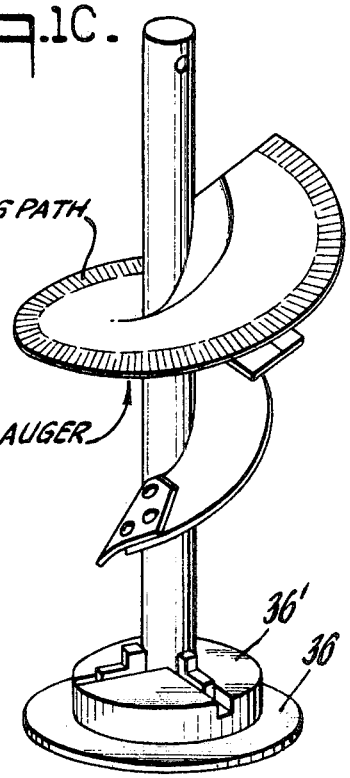
Figure 1B:
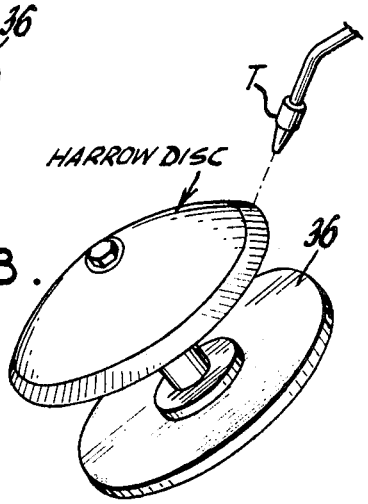

Workpiece: Harrow Disc, 20-inch diameter and dished, being catalog Part No. "JD 35 ·B 3134" of Deere & Co., Moline, Illinois; convex surface to be coated with 0.75-inch wide circumferentially continuous annular path. Mounted at center, to pedestal on turntable 36, as shown in FIG. 1B, with cradle tilted about 30 degrees to permit torch oscillating traverse to be at substantially uniform spacing from instataneously treated region of convex surface.

Oscillating Traverse Span: 1.00 inch

Traverse Cycle: 1 per second

Metal-Spray duty cycle: 20 to 25 percent of two-cycle period of oscillation.

Feed: Continuous $\theta$ rotation

Feed rate: About 18 to 20 min/rev.

Metal powder, at 58: "LUBROTEC 19985"; about 15 ounces consumed per treated edge; coated-thickness layer (98) of about 0.025 inch.

REMARKS: Smooth and continuous, as in Example I.

EXAMPLE III

Workpiece: Helical Earth-Auger, 18-inch diameter by 13.5-inch advance/turn, being catalog Part No. "JD HDG 530" of Deere & Co.; periphery of lower surface of blade to be coated with 1.5-inch wide continuous path. Auger stem held inverted by lathe chuck 36' secured to turntable 36, with stem axis vertical, for $\theta$ rotation about vertical axis, as shown in FIG. 1C.

Oscillating Traverse Span: 1.75 inch

Traverse Cycle: 0.6 per second

Metal-spray duty cycle: 20 to 25 percent of two-cycle period of oscillation.

Feed: Continuous $\theta$ rotation, with synchronized Z-axis drive, mechanically geared synchronizing of these feeds being as suggested schematically at 99 in FIG. 2.

Feed rate: 25 to 28 minutes for the single-turn helical advance of the workpiece.

Metal Powder, at 58: "LUBROTEC 19985"; about 30 ounces consumed per treated edge; coated-thickness layer (98) of about 0.025 to 0.030 inch.

REMARKS: Smooth and continuous, as in Examples I and II.

While the invention has been described in detail for the presently preferred form, it will be understood that modifications may be made without departing from the invention. For example, the torch T which happens to be of the internal-powder-feed variety may and in certain cases preferably is replaced by an external-powder-feed torch, or a two-powder-feed torch, as of the kind described in greater detail in my copending patent application Ser. No. 728,202, filed Sept. 30, 1976, now U.S. Pat. No. 4,099,481.

What is claimed is:

1. The method of using a gas torch to apply a smooth and continuous metal coating along a predetermined path on a surface of a metal substrate, which method comprises igniting the torch and directionally applying its discharge to a local region of said path, oscillating said discharge in a regular periodic traverse sweep of said path, continuously advancing said discharge along said path at a relatively slow rate compared to that of the oscillating traverse sweep, and intermittently adding metal powder to the torch flow in synchronism with the oscillating sweep cycle, said last step occurring in a regular pattern in which single powder-spraying sweeps involving metal-powder addition to the torch flow are spaced by full-sweep intervals of the sweep cycle without metal-powder addition, the relatively slow rate of advance along said path and the interval between successive powder-spraying sweeps being selected such that the bead of sprayed metal on the substrate for each successive powder-spraying sweep at least partially overlaps the previously sprayed bead, whereby the sweep intervals without metal-powder addition are fusing sweeps which enhance the smooth and continuous nature of the resultant metal coating and its bond to the metal substrate.

2. The method of claim 1, in which the pattern of powder-spraying sweeps vs. non-spraying sweeps of continuous torch operation is 1 to 4.

3. The method of claim 1, in which the predetermined path is generally rectilinear.

4. The method of claim 1, in which the predetermined path is generally arcuate, and in which the metal substrate is mounted for rotation such that torch oscillation periodically traverses the width of the predetermined path.

5. The method of claim 1, in which the predetermined path is curvilinear, and in which the metal substrate and torch are displaced in such curvilinear multiple-component advancing relative motion as to cause the predetermined path to be traversed by said sweep at a substantially constant and relatively short torch-discharge distance.

* * * * *